US008377353B2

(12) United States Patent
Green et al.

(10) Patent No.: US 8,377,353 B2
(45) Date of Patent: Feb. 19, 2013

(54) PROCESS OF MAKING CONJUGATE FIBERS

(75) Inventors: Robert A. Green, Cary, NC (US); Chad Henry Kamann, Carver, MN (US); Jeffrey John Kolstad, Wayzata, MN (US); Christopher M. Ryan, Maple Grove, MN (US)

(73) Assignee: NatureWorks LLC, Minnetonka, MN (US)

( * ) Notice: Subject to any disclaimer, the term of this patent is extended or adjusted under 35 U.S.C. 154(b) by 401 days.

(21) Appl. No.: 12/679,373

(22) PCT Filed: Sep. 26, 2008

(86) PCT No.: PCT/US2008/077803

§ 371 (c)(1),
(2), (4) Date: Mar. 22, 2010

(87) PCT Pub. No.: WO2009/042837

PCT Pub. Date: Apr. 2, 2009

(65) Prior Publication Data

US 2010/0221471 A1 Sep. 2, 2010

Related U.S. Application Data

(60) Provisional application No. 60/995,899, filed on Sep. 28, 2007.

(51) Int. Cl.

| | |
|---|---|
| ***D01D 5/088*** | (2006.01) |
| ***D01D 5/12*** | (2006.01) |
| ***D01D 5/34*** | (2006.01) |
| ***D01D 5/36*** | (2006.01) |
| ***D01F 8/14*** | (2006.01) |

(52) U.S. Cl. ..... 264/172.13; 264/172.15; 264/210.4; 264/210.5; 264/210.8; 264/211.14; 264/211.15; 264/211.16; 264/211.17

(58) Field of Classification Search ..... 264/172.13, 264/172.15, 210.4, 210.5, 210.8, 211.14, 264/211.15, 211.16, 211.17
See application file for complete search history.

(56) References Cited

U.S. PATENT DOCUMENTS

| | | | | |
|---|---|---|---|---|
| 5,010,145 | A | 4/1991 | Ikada | |
| 5,254,299 | A | 10/1993 | Krupp | |
| 5,270,400 | A | 12/1993 | Spinu | |
| 5,290,626 | A | 3/1994 | Nishioi | |
| 6,761,970 | B2 | 7/2004 | Ochi | |
| 2002/0065363 | A1 * | 5/2002 | Wang et al. | 525/58 |
| 2002/0192449 | A1 * | 12/2002 | Hobbs et al. | 428/297.4 |
| 2003/0038405 | A1 * | 2/2003 | Bopp et al. | 264/319 |
| 2003/0082360 | A1 * | 5/2003 | O'Donnell et al. | 428/292.1 |
| 2007/0172651 | A1 | 7/2007 | Miyoshi | |
| 2008/0287024 | A1 | 11/2008 | Chakravarty | |
| 2009/0110927 | A1 | 4/2009 | Mochiduki | |

FOREIGN PATENT DOCUMENTS

| | | | |
|---|---|---|---|
| EP | 288041 | A | 10/1988 |
| EP | 1731633 | A | 12/2006 |
| JP | 2002-030523 | A | 1/2002 |
| JP | 2002-356543 | A | 12/2002 |
| JP | 2006-028336 | A | 2/2006 |
| JP | 2006-299244 | A | 11/2006 |
| JP | 2006-307071 | A | 11/2006 |
| WO | 2006-104092 | A | 10/2006 |
| WO | 2007-070064 | A | 6/2007 |
| WO | 2009-042837 | A | 4/2009 |
| WO | 2009-045881 | A | 4/2009 |
| WO | 2009-045887 | A | 4/2009 |

* cited by examiner

*Primary Examiner* — Leo B Tentoni
(74) *Attorney, Agent, or Firm* — Gary C Cohn PLLC

(57) ABSTRACT

Conjugate fibers are prepared in which at least one segment is a mixture of a high-D PLA resin and a high-L PLA resin. These segments have crystallites having a crystalline melting temperature of at least 200° C. At least one other segment is a high-D PLA resin or a high-L PLA resin. The conjugate fibers may be, for example, bicomponent, multi-component, islands-in-the-sea or sheath-and-core types. Specialty fibers of various types can be made through further downstream processing of these conjugate fibers.

14 Claims, No Drawings

PROCESS OF MAKING CONJUGATE FIBERS

This application claims benefit of U.S. Provisional Application No. 60/995,899, filed 28 Sep. 2007.

This invention relates to a process for making conjugate fibers from a polylactide stereocomplex.

Polylactide resins (also known as polylactic acid, or PLA) are now available commercially. These resins can be produced from annually renewable resources such as corn, rice or other sugar- or starch-producing plants. In addition, PLA resins are compostable. For these reasons, there is significant interest in substituting PLA into applications in which oil-based thermoplastic materials have conventionally been used. To this end, PLA has been implemented into various applications such as fibers for woven and nonwoven applications.

A problem with PLA resins is that they usually have heat resistance that is inadequate for some applications. PLA resins generally exhibit a crystalline melting temperature ($T_m$) in the range from 140 to 160° C. Due to the relatively low crystalline melting temperature, the PLA products are often susceptible to heat damage (shrinkage or melting) when ironed or heated in a dryer.

Somewhat better high temperature performance can be obtained by introducing higher-melting "stereocomplex" crystallinity into the polymer. Because lactic acid contains a chiral carbon atom, it exists in both D-(R-) and L-(S-) forms. This chirality is preserved when the lactic acid is formed into a PLA resin, and so each repeating lactic acid unit in the polymer has either the D- or the L-configuration. Mixtures of a PLA resin that predominantly contains D-lactic acid units with another PLA resin that predominantly contains L-lactic acid units can form a crystalline structure that is known as a "stereocomplex". The stereocomplex crystallites exhibit a crystalline melting temperature as much as 60° C. higher than that of the high D- or high L-resin by itself. In principle, the heat resistance of a PLA fiber can be increased quite significantly if these stereocomplex crystallites are present in sufficient quantities. Other potential advantages of forming PLA stereocomplexes include better solvent resistance and dyeability, compared to normal PLA fibers, and the ability to texture and crimp the fibers at higher production rates. The stereocomplex is expected to exhibit better resistance to finishing chemicals and its better solvent resistance can make it of interest in certain filter applications.

However, PLA stereocomplexes are so difficult to melt process into fibers that no commercial PLA stereocomplex fiber product has been developed. The processing problem is due in part to the high crystalline melting temperature of the stereocomplex. PLA resins degrade rapidly at temperatures needed to melt the stereocomplex crystallites. This makes it difficult to melt-process the materials, as polymer molecular weight is lost rapidly when the stereocomplex is spun into fibers. The loss of molecular weight can have a significant adverse affect on the properties and processing of the fibers. In addition, stereocomplex crystallites often do not form in the finished fiber, or else have a melting temperature that is lower than expected. Because of this, the fibers sometimes do not have the expected heat resistance.

Research scale methods have attempted to circumvent this problem by spinning stereocomplex fibers from solution. Solution spinning allows lower temperatures to be used, so less polymer degradation is seen. But this is an unsatisfactory approach from the standpoint of commercial production, as the use of solvents increases costs, adds much complexity to the process, and raises concerns about worker exposure to volatile organic materials. Melt processing methods are needed to make stereocomplex fibers economically on a large scale.

There is a particular interest in producing so-called "conjugate" fibers from PLA resins, again with better heat properties than have been realized to date. "Conjugate" fibers are multicomponent fibers having two or more discrete segments. At least one segment is made from a different resin composition than at least one other segment. Various types of conjugate fibers are known, including "island-in-the-sea" types, "side-by-side" bicomponent or multicomponent types, "sheath-and-core" types which have a central "core" segment surrounded by a "sheath" segment of another resin, and so-called "splittable" fibers. The various types of conjugate fibers are in some cases useful as such, and in other cases are useful intermediate products that can be subjected to downstream processing to form specialty types of fibers, such as microfibers and hollow fibers.

This invention is a process for making a conjugate fiber, wherein at least one segment of the conjugate fiber is a PLA resin having, per gram of PLA resin in the segment, at least 20 J of crystallites having a melting temperature of at least 200° C., comprising a) coextruding 1) a mixture of a high-D PLA starting resin and a high-L PLA starting resin with 2) a second resin which is not a mixture of a high-D PLA starting resin and a high-L PLA starting resin, to form a segmented extrudate in which at least one segment contains the mixture of a high-D PLA resin and a high-L PLA resin and at least one other segment contains the second resin;

b) cooling the extrudate to below the crystalline melting temperature of each of the PLA resins to form a conjugate fiber; and c) heat treating at least the segment or segments of the conjugate fiber that contain the mixture of a high-D PLA resin and a high-L PLA resin at a temperature between the glass transition temperature of the PLA starting resins and the crystallization melting temperature of the PLA starting resins for a period of time such that the segments or segments containing the mixture of the high-D PLA starting resin and the high-L PLA starting resin form, per gram of PLA resins in said segment or segments, at least 20 Joules of crystallites having a crystalline melting temperature of at least 200° C.

Preferred processes further include the step d) of, after step b) or c), separating at least one segment containing the mixture of the high-D PLA resin and the high-L PLA resin from at least one segment containing the second resin.

In a specific embodiment, the invention is a process for making a microfiber of a polylactic acid stereocomplex, comprising a) extruding an islands-in-the-sea type conjugate fiber, wherein the island portions of the conjugate fiber contain a mixture of a high-D PLA starting resin and a high-L PLA starting resin and the sea portion of the conjugate fiber contains a second resin and;

b) drawing the conjugate fiber such that the island portions of the conjugate fiber assume a diameter of 0.5 micron or less;

c) either prior to, during or after step b), heat treating the conjugate fiber at a temperature between the glass transition temperature of the PLA starting resins and the crystallization melting temperature of the PLA starting resins for a period of time such that the island portions of the conjugate fiber contain, per gram of PLA resin, at least 20 J of crystallites having a crystalline melting temperature of at least 200° C.; and following steps b) and c), d) separating the sea portion of the conjugate fiber from the island portions of the conjugate fiber to form microfibers corresponding to the island portions of the conjugate fiber.

In another specific embodiment, the invention is a process for making a sheath-and-core conjugate fiber, comprising a) extruding a conjugate fiber having a core portion and a sheath portion, wherein either the core or the sheath portion of the conjugate fiber contains a mixture of a high-D PLA starting resin and a high-L PLA starting resin and the other portion of the conjugate fiber contains a second resin;

b) drawing the conjugate fiber; and c) either prior to, during or after step b), heat treating the portion of the conjugate fiber that contains the mixture of the high-D PLA starting resin and the high-L PLA starting resin at a temperature between the glass transition temperature of the PLA starting resins and the crystallization melting temperature of the PLA starting resins for a period of time such that such portion contains, per gram of PLA resin, at least 20 J of crystallites having a crystalline melting temperature of at least 200° C.

In a further specific embodiment, the sheath portion of the sheath-and-core conjugate fiber contains the mixture of high-D PLA starting resin and high-L PLA starting resin, and the core portion of the conjugate fiber is made of the second resin. In such an embodiment, the core portion can be removed from the conjugate fiber to produce a hollow fiber containing the mixture of high-D PLA starting resin with the high-L PLA starting resin.

This invention is also a conjugate fiber having at least two segments wherein at least one segment of the conjugate fiber contains a mixture of a high-D PLA resin and a high-L PLA resin wherein such segment or segments contain, per gram of PLA resin in each such segment, at least 20 J of crystallites having a crystalline melting temperature of at least 200° C., and at least one other segment contains a second resin.

This invention is also a conjugate fiber of the islands-in-the-sea type, wherein the island portions of the conjugate fiber contain a mixture of a high-D PLA resin and a high-L PLA resin, and the sea portion of the conjugate fiber contains a second resin. In certain embodiments, the island portions contain, per gram of PLA resin in the island portions, at least 20 J of crystallites having a crystalline melting temperature of at least 200° C.

The invention is also a PLA microfiber having a diameter of 0.5 micron or less and a crystalline melting temperature of at least 200° C.

The invention is also a sheath-and-core conjugate fiber wherein either the core or the sheath portion of the conjugate fiber contains a mixture of a high-D PLA resin and a high-L PLA resin. In certain embodiments, the portion of the fiber that contains the mixture of high-D and high-L PLA resins contain, per gram of PLA resin in such portions, at least 20 J of crystallites having a crystalline melting temperature of at least 200° C.

The invention is also a hollow fiber of a mixture of a high-D PLA resin and a high-L PLA resin. In certain embodiments, the hollow fiber contains, per gram of PLA resin, at least 20 J of crystallites having a crystalline melting temperature of at least 200° C.

In any of the foregoing aspects of the invention, the second resin may be a PLA resin. That PLA resin may be a high-D PLA resin, a high-L PLA resin, or a PLA resin that is neither a high-D nor high-L PLA resin. However, the second resin cannot be or contain a mixture of a high-D PLA resin with a high-L PLA resin at ratio of 20:80 to 80:20 by weight.

For the purposes of this invention, the terms "polylactide", "polylactic acid" and "PLA" are used interchangeably to denote polymers having repeating units of the structure —OC(O)CH($CH_3$)—. The PLA resin preferably contains at least 90%, such as at least 95% or at least 98% by weight of those repeating units. These polymers are readily produced by polymerizing lactic acid or, more preferably, by polymerizing lactide.

Lactic acid exists in two enantiomeric forms, the so-called "L-" and "D-" forms. The —OC(O)CH($CH_3$)— units produced by polymerizing lactic acid or lactic retain the chirality of the lactic acid. A PLA resin will therefore contain, in polymerized form, one or both of the "L" and the "D" enantiomers. In this invention, a "high-D" PLA resin is one in which the D-enantiomer constitutes at least 90% of the polymerized lactic acid repeating units in the polymer. The polymerized D-enantiomer preferably constitutes at least 95% by weight of the polymerized lactic acid repeating units in the high-D starting resin. The high-D PLA resin may contain up to essentially 100% of the polymerized D-enantiomer, based on the weight of polymerized lactic acid repeating units in the polymer. The high-D PLA resin more preferably contains at least 95.5% of the polymerized D-enantiomer, and most preferably contains from 95.5 to 99% of the polymerized D-enantiomer, based on the total weight of polymerized lactic acid repeating units in the polymer.

Similarly, a high-L PLA resin is one in which the L-enantiomer constitutes at least 90% of the polymerized lactic acid repeating units in the polymer. The polymerized L-enantiomer preferably constitutes at least 95% by weight of the polymerized lactic acid repeating units in the high-L starting resin. The high-L PLA resin may contain essentially 100% of the polymerized L-enantiomer, based on the weight of polymerized lactic acid repeating units in the polymer. The high-L PLA resin more preferably contains at least 95.5% of the polymerized L-enantiomer, and most preferably contains from 95.5 to 99% of the polymerized L-enantiomer, based on the total weight of polymerized lactic acid repeating units in the polymer.

A PLA resin that contains at least 10% of each of the D-enantiomer and L-enantiomers based on their combined weights is, for purposes of this invention, neither a high-D PLA resin nor a high-L PLA resin. Such as resin is sometimes referred to herein as an "amorphous" PLA resin, as such resins crystallize with difficulty if at all.

The high-D and high-L PLA starting resins used in the invention each have molecular weights that are high enough for melt processing applications. A number average molecular weight in the range of 20,000 to 150,000, as measured by gel permeation chromatography against a polystyrene standard, is generally suitable, although somewhat higher and lower values can be used in some circumstances. The molecular weight of the high-D and high-L PLA starting resins may be similar to each other (such as a number average molecular weight difference of 20,000 or less). It is also possible that the molecular weights of the high-D and high-L starting resins differ by a larger amount.

Either or both of the high-D PLA starting resin and the high-L PLA starting resin may further contain repeating units derived from other monomers that are copolymerizable with lactide or lactic acid, such as glycolic acid, hydroxybutyric acid and other hydroxyacids and their respective dianhydride dimers; alkylene oxides (including ethylene oxide, propylene oxide, butylene oxide, tetramethylene oxide, and the like); cyclic lactones; or cyclic carbonates. Repeating units derived from these other monomers can be present in block and/or random arrangements. Such other repeating units preferably constitute from 0 to 5% by weight of the PLA resin, if they are present at all. The high-D and high-L PLA starting resins are most preferably essentially devoid of such other repeating units.

The starting high-D and high-LPLA resins may also contain residues of an initiator compound, which is often used during the polymerization process to provide control over molecular weight. Suitable such initiators include, for example, water, alcohols, glycol ethers and polyhydroxy compounds of various types (such as ethylene glycol, propylene glycol, polyethylene glycol, polypropylene glycol, glycerine, trimethylolpropane, pentaerythritol, hydroxyl-terminated butadiene polymers and the like). A compound having at least one hydroxyl group and at least one carboxyl group, such as lactic acid or a linear lactic acid oligomer, is also suitable. The initiator residue preferably constitutes no more than 5%, especially no more than 2%, of the weight of the high-D and high-L PLA starting resins, except when the initiator is lactic acid or a lactic acid oligomer, in which case the initiator may constitute a greater proportion of the molecule.

A particularly suitable process for preparing the high-D and high-L PLA starting resins by polymerizing lactide is described in U.S. Pat. Nos. 5,247,059, 5,258,488 and 5,274,073. This preferred polymerization process typically includes a devolatilization step during which the free lactide content of the polymer is reduced, preferably to less than 1% by weight, more preferably less than 0.5% by weight and especially less than 0.2% by weight.

The polymerization catalyst is preferably deactivated or removed from the high-D and high-L PLA starting resins. Residues of a polymerization catalyst can catalyze transesterification reactions between the PLA starting resins when they are mixed together in the melt. This transesterification can in some cases, render the resins incapable of forming high-melting "stereocomplex" crystallites. In other cases, the transesterification reactions can result in a reduction of the melting temperature of the "stereocomplex" crystallites. The transesterification reactions also tend to reduce molecular weights. For these reasons, it is also preferred not to add other materials to the starting resins that can cause the high-D and high-L PLA starting resins to transesterify with each other significantly.

According to the invention, a conjugate fiber is formed by coextruding 1) a mixture of a high-D PLA starting resin and a high-L PLA starting resin and 2), a second resin. A segmented extrudate is formed. At least one segment contains the mixture of the high-D PLA resin with the high-L PLA resin. At least one other segment of the extrudate is of the second resin.

The second resin can be any thermoplastic material or mixture of thermoplastic materials that is capable of being melt-spun into a fiber, other than a mixture containing a high-D PLA resin with a high-L PLA resin at a weight ratio of between 20:80 and 80:20. The second resin can be, for example, a polyamide such as the various nylons, a polyester such as PET, a polyolefin, a thermoplastic polyurethane, or other extrudable resin. A PLA resin is a preferred second resin. The PLA resin may be a high-D PLA resin, a high-L PLA resin, or an amorphous PLA resin. If the second resin is a PLA resin, its molecular weight and other characteristics (other than enantiomer contents) are generally as described above with respect to the high-D and high-L PLA resin.

The conjugate fiber may be one of many types. A simple type is a side-by-side bicomponent fiber, in which one segment of each type is formed and the two segments are longitudinally joined adjacent to each other. A variation on the side-by-side bicomponent fiber is a multicomponent type, in which three or more segments are formed and longitudinally joined. In cross-section, multicomponent fibers of this type often resemble a sliced pie.

A conjugate fiber of particular interest is an island-in-the-sea type. An island-in-the-sea conjugate fiber is a multifilament type of fiber characterized in that multiple, longitudinally continuous filaments of a first type of polymer (the islands), which are separated by regions of filaments of a second polymer type (the sea). The regions made up of the filaments of the second polymer type are usually contiguous with each other. Viewed in cross-section, the filaments of the first polymer type appear as discrete, separate bodies (islands) that are separated by the regions of filaments of the second polymer type (the sea). Islands-in-the-sea type conjugate fibers are well-known, being described, for example, in U.S. Pat. No. 5,290,626 and at www.hillsinc.net.

Another conjugate fiber of particular interest is a sheath-and-core type, characterized in having a central segment which is substantially completely surrounded by an outer sheath.

The coextrusion step is conveniently conducted in known manner, by heating the respective resins and resin mixtures to above their crystalline melting temperatures, and feeding the mixture through a spinneret which forms the conjugate fiber. The spinneret contains internal apparatus through which the different starting resins are each extruded in the form of discrete longitudinal sections, in the desired spatial relationship with respect to one another. The melt spinning temperature is suitably done at a temperature of at least 160° C., to as high as 250° C. A preferred temperature is at least 215° C. to about 250° C. to obtain a reasonable melt viscosity.

At least one segment of the coextruded fiber contains a mixture of a high-D PLA resin and a high-L PLA resin. The weight ratio of the high-D and high-L resins in the mixture is suitably between 25:75 and 75:25. A more preferred weight ratio is from 30:70 to 70:30 and an even more preferred weight ratio is from 40:60 to 60:40. A weight ratio of from 45:55 to 55:45 is especially preferred. Approximately equal quantities by weight are most preferably used.

The mixture of the high-D and high-L PLA resins can be formed in various ways. In one approach, particles or pellets of each type are blended at the desired weight ratio, and the particulate mixture is then melted and extruded. In another approach, the high-D and high-L PLA resins are melted separately and then mixed at or just before the spinning step. This approach has the advantage of reducing the amount of time that the high-D and high-L PLA resins are exposed to each other at temperatures above their respective melting temperatures. A third approach is to melt-blend or solution-blend the high-D and high-L PLA resins beforehand, to produce particles or pellets containing the mixture. The particles or pellets are then melted and extruded to make the fibers.

In most cases, the extruded conjugate fiber will be drawn to reduce its diameter and the diameters of its various constituent segments. The drawing can be done in various ways, all of which are suitable. Drawing can be done by mechanically stretching the conjugate fiber as it is spun or afterwards, such as by winding it or otherwise pulling it away from the spinneret at a greater longitudinal rate than at which it is spun. The conjugate fiber can also be drawn using a melt-blowing method, such as is described in U.S. Pat. No. 5,290,626.

Crystallites are formed in the segment(s) of the conjugate fiber that contain the mixture of the high-D and high-L PLA resins. The segment(s) are subjected to a heat treatment step, in which the fiber is heated to a temperature between the glass transition temperatures of the starting high-D and high-L PLA resins and the crystallization melting temperature of the starting high-D and high-L PLA resins. This can be performed on the conjugate fiber as a whole, or only on the segments of interest, after separating them from the other segments of the conjugate fiber. The heating is conducted for a period of time such that the segment or segments of the mixture of high-D PLA resin and high-L PLA resin develop, per gram of PLA resin in the segment or segments, at least 20 J of crystallites that have a crystalline melting temperature of at least 200° C. The crystallites preferably have a crystalline melting temperature of at least 210° C., at least 215° C. or at least 220° C. These crystallites may have a melting temperature of up to about 235° C. These crystallites are believed to be associated with the formation of a stereocomplex of the high-D and high-L PLA resins. The segment or segments may, after heat-treatment contain 25 J or more, 30 J or more, 35 J or more, or even 40 J or more of these high-melting crystallites, per gram of PLA resin in the segment or segments. It may take from several seconds to several minutes of heating to develop this crystallinity.

The heat treatment step may also cause lower-melting crystallites that have a crystalline melting temperature of from about 140 to 190° C. to form in the segments that contain the mixture of the high-D and high-L PLA resins. Crystallites of this type are believed to be structures formed by the crystallization of either the high-D PLA polymer or the high-L PLA polymer by itself. The formation of these lower-melting crystallites is less preferred. Preferably, no more than 20 J of these crystallites are formed during the heat setting process per gram of PLA resin in those segment or segments which contain the mixture of the high-D and high-L PLA resins. More preferably, no more than 15 J of these lower melting crystallites are formed, and even more preferably, no more than 10 J of these lower melting crystallites are formed per gram of PLA resins in those segment or segments. In most preferred processes, from 0 to 5 J of the lower melting resin crystallites are formed in those segments, per gram of PLA resin contained therein.

Some crystallization of the segment or segments of the conjugate fiber that contain the second resin also may occur either during the spinning process or during the heat treatment step (if the heat treatment step is conducted on the entire conjugate fiber). This will depend on the polymer or polymers that constitute the second resin, and possibly on the conditions of the spinning and heat treatment steps. For example, crystallization usually will occur in those segment(s) in cases where the second resin is a high-D or high-P PLA resin. Because only the high-D resin or the high-L resin is present in those cases, the crystallization that occurs in those segments will be the lower melting type described above, not the higher melting "stereocomplex" crystallization. The amount of lower-melting crystallites that are developed in these segments is not considered to be critical to the invention.

Crystallization melting temperatures and the amount of crystallinity in a fiber sample are determined for purposes of this invention by differential scanning calorimetry (DSC), using the methods described in U.S. Pat. No. 6,506,873.

Once the requisite amount of high melting crystallites have been formed, the segment(s) are cooled to below the glass transition temperature, which will prevent further crystallization of the high-D and high-L PLA resins.

In processes of particular interest, at least one segment made of the second resin is separated from at least one segment that contains the mixture high-D and high-L PLA resins. This can be done before or after the heat treatment step. Depending on the geometry of the conjugate fiber, what remains when the segments are separated is a low denier fiber or a fiber having a specialized geometry, such as a hollow fiber. There are three primary approaches to accomplishing selectively removing segments from a conjugate fiber.

One approach is to dissolve one or more of the segments containing the second resin, leaving the remaining segment(s) (generally those containing the mixture of the high-D and high-L resins) behind. This may be done before the heat treatment step, but is preferably done after subjecting the entire conjugate fiber to the heat treatment step, especially if the second resin is a PLA resin. Surprisingly, it has been found that the segments containing the high-melting "stereocomplex" crystallites are more resistant to dissolution in various solvents than are segments made from only one PLA resin. As a result, dissolution methods even can be used to separate segments containing the mixture of high-D and high-L PLA resins from segments containing only one PLA resin.

The solvent that is used in this approach will of course depend on the nature of the second resin. A suitable solvent for dissolving segments of a single PLA resin is an aqueous alkali solution. Such a solution may degrade the PLA resin as part of the dissolution process. Alternatively, any other solvent for the second resin can be used. Example of suitable organic solvents include, for example, chloroform, dimethylfuran, toluene, 1,1,2,2-tetrachloroethane, N-methylpyrrolidone, tetrahydrofuran, methylene chloride, acetonitrile, and m-cresol.

The second approach is a thermal approach, which takes advantage of the different in crystalline melting temperatures of the segments of the conjugate fiber. This is performed after heat treating the conjugate fiber as a whole. In this method, the conjugate fiber is heated to above the melting temperature of some but not all of the segments, to selectively melt the segments having the lower melting temperature. When the second resin is a PLA resin, the conjugate fiber can be heated to about 180-205° C. to allow the segments containing only one PLA resin to melt, leaving the segments with the high-melting crystallites behind.

A third approach is a mechanical approach, in which the segments are mechanically separated. This approach works best when the second resin does not adhere strongly to the mixture of the high-D and high-L PLA resins.

In certain embodiments of this invention, the conjugate fiber is an "islands-in-the-sea" type. In these embodiments, a mixture of a high-D PLA resin and a high-L PLA resin is extruded to form the filaments that constitute the "islands" portion of the conjugate fiber. The sea portion of the conjugate fiber includes filaments of the second resin. As before, the second resin may be a PLA resin. The island portions of the conjugate fiber can constitute from 5 to as much as 70 percent of the cross-sectional area of the conjugate fiber. Generally, the islands make up as much of the conjugate fiber as possible for reasons of cost and efficiency. Preferably, the island portions constitute from 30 to 60 percent of the cross-sectional area of the conjugate fiber.

Islands-in-the-sea conjugate fibers are often further processed to form microfibers, by selectively removing the "sea" portion of the fiber, leaving the "islands" behind. Removal methods are as described before, with dissolution methods being preferred. The resulting microfibers contain at least 20 J of crystallites that have a melting temperature of at least 200° C., preferably at least 215° C., per gram of PLA resins, and have a diameter of 0.5 microns or less. Their diameters may be as little as 5 nanometers. A preferred diameter range is from 10 to 300 nanometers and a more preferred range is from 20 to 100 nanometers. These microfibers are useful for making various types of yarns and fabrics. They are useful in nonwoven applications such as spunbonding, spunlacing, and needlepunching processes. They can also be formed into yarns for weaving or knitting. They are useful in making synthetic leathers and suedes. The yarns and fabrics are characterized in having greater thermal stability than do conventional PLA fibers, and so are more resistant to damage in ironing, drying or other thermal treatments.

Sheath-and-core conjugate fibers, in which the "sheath" contains the high-melting "stereocomplex" crystallites, are useful for making hollow fibers. This is done by selectively removing the "core", which contains only one of the PLA starting resins and thus does not contain the high-melting "stereocomplex" crystallites, in the manner described before. The resulting product is a hollow fiber of a mixture of a high-D and a high-L PLA resin that contains crystallites having a crystalline melting temperature of at least 200° C., preferably at least 215° C. and even more preferably at least 220° C.

Alternatively, sheath-and-core conjugate fibers can be used as binder fibers to make nonwovens. In these cases, the sheath typically contains the second resin and the core contains the mixture of high-D and high-L resins with high-melting "stereocomplex" crystallites. Thus, for example, a mat of these sheath-and-core conjugate fibers can be formed, and then heated to a temperature above the crystalline melting temperature of the sheath but below that of the core. In this manner, the sheath softens and adjacent fibers become melt bonded together, while preserving the fibrous nature of the material and the thermal properties of the core.

Sheath-and-core conjugate fibers in which the sheath contains the second resin and the core contains the mixture of high-D and high-L resins with high-melting "stereocomplex" crystallites can be used to make smaller diameter fibers, by selectively dissolving the sheath using methods as described before.

Bicomponent and multicomponent conjugate fibers are useful to make nonwovens, in methods analogous to those described before with respect to making nonwovens from sheath-and-core conjugate fibers. Bicomponent and multicomponent conjugate fibers may also be "split" into their constituent segments to form finer denier products.

The following examples are provided to illustrate the invention, and are not intended to limit the scope thereof. All parts and percentages are by weight unless otherwise indicated.

Examples 1 and 2 and Comparative Samples A and B

A sheath-core type conjugate fiber is prepared as follows. The fibers include a core portion of a high-L PLA resin and a sheath that contains a 50/50 mixture of a high-D PLA resin with a high-L PLA resin. The high-L PLA resin in each case is a poly(lactide) containing 98.8 weight percent of polymerized L-lactide and 1.2 weight percent of polymerized D-lactide. The high-L PLA resin has a number average molecular weight of from 70,000 to 100,000. The high-D PLA resin has a number average molecular weight of about 65,000 and contains in excess of 99.5% by weight of polymerized D-lactide.

The 50/50 mixture of high-D and high-L PLA resins is melted in a first four-zone extruder. More of the high-L PLA resin is separately melted in a second four-zone extruder. The separate melts are brought to a temperature of 223-228° C. and processed through a Hills bicomponent spinpack adapted to produce sheath-core conjugate fibers. Feed rates to the spinpack are such that the mixture of resins forms a sheath that constitutes 30% of the total weight of the fiber, and the high-L PLA resin constitutes the core of the fiber. The fibers are spun at a rate of 2500 meters per minute, and quenched with 14° C. air flowing at a rate of 0.4 m/s. A fiber bundle containing 72 filaments of the sheath-core fiber is formed. The fiber bundle has a denier of 367.

The fiber bundle is simultaneously drawn and heat treated by preheating to 95° C. and drawing over a draw stand that is heated to 155° C. The fiber bundle is drawn to a denier of 198. The resulting fiber product is designated Example 1.

Example 2 is made in the same general manner, this time producing a bundle of sheath-core fibers having 20% by weight sheath and 80% by weight core. After drawing and heat setting, the fiber bundle has a denier of 220.

Fiber Examples 1 and 2 are separately knitted into stockings, and the knit fabrics are ironed at various iron settings. The samples are tested by setting the iron to the desired setting, allowing it to equilibrate face down on a terry cloth, and then moving the iron over the sample for 10-15 seconds. The ironed samples are rated subjectively for hand/feel on a scale of 1 to 5, with 5 being softest (best) and 1 being the hardest. Results are as in Table 1 below. Other observations are also reported in Table 1.

For comparison, a 190 denier fiber is made in the same way, except that only the poly-L-PLA resin is used, so that the filaments do not have the sheath-core configuration (Comparative Sample A). Comparative Sample B is a 217 denier fiber made in the same way as Comparative Sample A.

TABLE 1

| Example or Comparative Sample No. | Hand/Feel Rating (Comments) | | | |
|---|---|---|---|---|
| | Before Ironing | 145-150° C. iron | 160-165° C. iron | 170-175° C. iron |
| A* | 5 | 3 | 1 | 1 |
| 1 | 5 | 4 | 2 | 1 |
| 2 | 5 | 4 | 2 | 1 |
| B* | 5 | 2 | 1 | 1 |

*Not an example of this invention.

These results indicate that the fibers of the invention have superior heat resistance, particularly at temperatures of form 145-165° C.

Duplicate socks are knit from each of Examples 1 and 2 and Comparative Samples A and B. The socks are then subjected to additional heating at 150° C. for 5 minutes, to attempt to induce additional high-melting crystallites to form in the sheath portions of Examples 1 and 2. The Comparatives are subjected to this heat treatment for purposes of providing controls. The heat treated socks are then ironed as before, with results as indicated in Table 2 below.

TABLE 2

| Example or Comparative Sample No. | Hand/Feel Rating (Comments) | | | |
|---|---|---|---|---|
| | Before Ironing | 160-165° C. iron | 170-175° C. iron | 180-185° C. iron |
| A* | 3 | 2 | 1 | 1 |
| 1 | 3 | 3 | 2 | 1 |
| 2 | 3 | 3 | 2 | 1 |
| B* | 3 | 2 | 1 | 1 |

The additional heat aging results in some additional stiffness in the socks before ironing, as indicated by the "3" rating. The comparative samples show some loss of softness when ironed at 160-165° C., although not as much loss as is the case when the socks are not subjected to the additional heat treatment. At both the 160-165° C. and 170-175° C. ironing temperatures, Examples 1 and 2 show better heat resistance on this ironing test, than do the Comparative Samples.

Example 1 fibers are analyzed by DSC after the additional heat treatment. The fibers are found to contain about 30 J/g of crystallites that have a melting temperature centered at about 170° C., and about 11 J/g of crystallites that have a melting temperature centered at about 220° C. The higher-melting crystallites are understood to be PLA stereocomplex crystallites. Because the fibers contain only 30% by weight of sheath, the DSC results indicate that the sheath portions contain about 37 J/g of stereocomplex crystallites. The lower-melting crystallites are believed to be crystals of the poly-L-PLA in the core. Because the core constitutes 70% of the weight of the polymer, these results indicate that the core contains about 43 J/g of poly-L-PLA resin crystallites.

Example 2 fibers are analyzed by DSC after the additional heat treatment, and found to contain about 35 J/g of crystallites that have a melting temperature centered at about 170° C., and about 7 J/g of crystallites that have a melting temperature centered at about 220° C. This reflects the higher proportion of sheath in Example 1 fibers as compared to Example 2 fibers.

Comparative Sample B contains 41 J/g of the lower-melting crystallites.

What is claimed is:

1. A process for making a conjugate fiber, wherein at least one segment of the conjugate fiber is a PLA resin having, per gram of PLA resin in the segment, at least 20 J of crystallites having a melting temperature of at least 200° C., comprising a) coextruding 1) a mixture of a high-D PLA starting resin and a high-L PLA starting resin with 2) a second resin which is not a mixture of a high-D PLA starting resin and a high-L PLA starting resin, to form a segmented extrudate in which at least one segment contains a mixture of a high-D PLA resin and a high-L PLA resin and at least one other segment contains the second resin;

b) cooling the extrudate to below the crystalline melting temperature of each of the PLA resins to form a conjugate fiber; and c) heat treating at least the segment or segments of the conjugate fiber that contain the mixture of a high-D PLA resin and a high-L PLA resin at a temperature between the glass transition temperature of the PLA starting resins and the crystallization melting temperature of the PLA starting resins for a period of time such that the segments or segments containing the mixture of the high-D PLA starting resin and the high-L starting resin form, per gram of PLA resins in said segment or segments, at least 20 Joules of crystallites having a crystalline melting temperature of at least 200° C.

2. The process of claim 1, wherein the mixture of the high-D PLA starting resin and the high-L PLA starting resin contains the high-D PLA starting resin and the high-L PLA starting resin at a weight ratio of from 40:60 to 60:40.

3. The process of claim 2, further comprising d), after step b) or c), separating at least one segment containing the mixture of the high-D PLA resin and the high-L PLA resin from at least one segment containing the second resin.

4. The process of claim 3 wherein step d) is performed by dissolving at least one segment containing the second resin.

5. The process of claim 3, wherein step d) is performed by melting at least one segment containing the second resin.

6. A process for making a microfiber of a polylactic acid stereocomplex, comprising a) extruding an islands-in-the-sea type conjugate fiber, wherein the island portions of the conjugate fiber contain a mixture of a high-D PLA resin and a high-L PLA resin and the sea portion of the conjugate fiber contains a second resin and;

b) drawing the conjugate fiber such that the island portions of the conjugate fiber assume a thickness of 0.5 micron or less;

c) either prior to, during or after step b), heat treating the conjugate fiber at a temperature between the glass transition temperature of the PLA starting resins and the crystallization melting temperature of the PLA starting resins for a period of time such that the island portions of the conjugate fiber contain, per gram of PLA resin, at least 20 J of crystallites having a crystalline melting temperature of at least 200° C.; and following steps b) and c), and d) separating the sea portion of the conjugate fiber from the island portions of the conjugate fiber to form microfibers corresponding to the island portions of the conjugate fiber.

7. The process of claim 6, wherein the mixture of the high-D PLA starting resin and the high-L PLA starting resin contains the high-D PLA starting resin and the high-L PLA starting resin at a weight ratio of from 40:60 to 60:40.

8. The process of claim 6, wherein in step b), the island portions of the conjugate fiber assume a thickness of from 10 to 300 nanometers.

9. The process of claim 6, wherein in step b), the island portions of the conjugate fiber assume a thickness of from 20 to 100 nanometers.

10. A process for making a sheath-and-core conjugate fiber, comprising a) extruding a conjugate fiber having a core portion and a sheath portion, wherein either the core or the sheath portion of the conjugate fiber contains a mixture of a high-D PLA starting resin and a high-L PLA starting resin and the other portion of the conjugate fiber contains a second resin;

b) drawing the conjugate fiber; and c) either prior to, during or after step b), heat treating the portion of the conjugate fiber that contains the mixture of the high-D PLA starting resin and the high-L PLA starting resin at a temperature between the glass transition temperature of the PLA starting resins and the crystallization melting temperature of the PLA starting resins for a period of time such that such portion contains, per gram of PLA resin, at least 20 J of crystallites having a crystalline melting temperature of at least 200° C.

11. The process of claim 10, wherein the mixture of the high-D PLA starting resin and the high-L PLA starting resin contains the high-D PLA starting resin and the high-L PLA starting resin at a weight ratio of from 40:60 to 60:40.

12. The process of claim 11, wherein the sheath portion of the conjugate fiber contains a mixture of a high-D PLA resin and a high-L PLA resin.

13. The process of claim 12, further comprising d) selectively removing the core from the conjugate fiber.

14. The process of claim 11, wherein the core portion of the conjugate fiber contains a mixture of a high-D PLA resin and a high-L PLA resin.

* * * * *